US011317180B2

(12) United States Patent
Zu et al.

(10) Patent No.: US 11,317,180 B2
(45) Date of Patent: Apr. 26, 2022

(54) ELECTRONIC DEVICE

(71) Applicant: Goertek Inc., Shandong (CN)

(72) Inventors: Fenglei Zu, Shandog (CN); Xinfeng Yang, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 17/055,018

(22) PCT Filed: Dec. 17, 2018

(86) PCT No.: PCT/CN2018/121431
§ 371 (c)(1),
(2) Date: Nov. 12, 2020

(87) PCT Pub. No.: WO2019/218662
PCT Pub. Date: Nov. 21, 2019

(65) Prior Publication Data

US 2021/0219035 A1 Jul. 15, 2021

(30) Foreign Application Priority Data

May 17, 2018 (CN) ..... 201810474569.X

(51) Int. Cl.
*H04R 9/06* (2006.01)
*H04R 1/02* (2006.01)
(Continued)

(52) U.S. Cl.
CPC ..... *H04R 1/023* (2013.01); *H04R 7/045* (2013.01); *H04R 9/02* (2013.01); *H04R 9/06* (2013.01);
(Continued)

(58) Field of Classification Search
CPC . H04R 1/023; H04R 3/14; H04R 5/02; H04R 7/045; H04R 9/04; H04R 9/02;
(Continued)

(56) References Cited

U.S. PATENT DOCUMENTS 6,332,029 B1 * 12/2001 Azima ..... H04R 1/021 381/152
7,050,600 B2 * 5/2006 Saiki ..... H04M 1/03 381/186
(Continued)

FOREIGN PATENT DOCUMENTS

CN 107295446 A 10/2017
CN 107483670 A 12/2017
(Continued)

*Primary Examiner* — Huyen D Le
(74) *Attorney, Agent, or Firm* — Baker Botts, LLP

(57) ABSTRACT

Disclosed is an electronic device, comprising a first exciter, a second exciter, and a first panel and a second panel that are provided oppositely. The first exciter is configured to control the first panel to vibrate, such that the first panel radiates a first sound wave. The second exciter is configured to control the second panel to vibrate, such that the second panel radiates a second sound wave. The electronic device of the present invention is provided with the two exciters to control each of the two panels to vibrate and radiate sound waves, such that both the first panel and the second panel can serve as a sound source. Controlling a vibration pattern of the second panel also enables control over a sound field of the first sound wave radiated by the first panel.

9 Claims, 4 Drawing Sheets

(51) Int. Cl.
*H04R 9/02* (2006.01)
*H04R 7/04* (2006.01)

(52) U.S. Cl.
CPC ..... *H04R 2400/11* (2013.01); *H04R 2440/05* (2013.01); *H04R 2499/11* (2013.01); *H04R 2499/15* (2013.01)

(58) Field of Classification Search
CPC .. H04R 9/06; H04R 2400/11; H04R 2440/05; H04R 2499/11; H04R 2499/15
See application file for complete search history.

(56) References Cited

U.S. PATENT DOCUMENTS

| | | | | |
|---|---|---|---|---|
| 2001/0040976 | A1* | 11/2001 | Buos | H04R 7/045 381/431 |
| 2016/0345091 | A1 | 11/2016 | Chu et al. | |
| 2017/0289694 | A1 | 10/2017 | Choi et al. | |
| 2019/0191240 | A1* | 6/2019 | Ham | H04R 1/025 |

FOREIGN PATENT DOCUMENTS

| | | | |
|---|---|---|---|
| CN | 207150818 | U | 3/2018 |
| CN | 108495244 | A | 9/2018 |
| EP | 3 331 251 | A1 | 6/2018 |

* cited by examiner

ELECTRONIC DEVICE

CROSS-REFERENCE TO RELATED APPLICATIONS

This application is a National Stage of international Application No. PCT/CN2018/121431, filed on Dec. 17, 2018, which claims priority to Chinese Patent Application No. 201810474569.X, filed on May 17, 2018, both of which are hereby incorporated by reference in their entireties.

TECHNICAL FIELD

The present invention relates to the technical field of screen sound production, and more particular to an electronic device that produces sound with a screen.

BACKGROUND

With the increasing demand from end customers for full-screen electronic devices, "non-porosity" becomes a basic requirement for acoustic solutions of full-screen electronic devices. One of the solutions to meet such requirements is screen sound production technology. For a typical electronic device including a first panel and a second panel provided oppositely, screen sound production means to attach a screen to one of the panels via an exciter to make the screen vibrate, and to achieve the effect of sound radiation.

Nevertheless, in conventional screen sound production technologies, no matter whether to directly drive a screen to vibrate or to drive the screen to vibrate via a resonance exciter, since only one panel is installed with an exciter and only one panel is made to vibrate and produce sound, it is not possible to control a sound field of the sound waves radiated by the panel.

SUMMARY

An object of embodiments of the present invention is to provide a new technical solution that can solve at least one of the above-mentioned problems, According to a first aspect of the present invention, an electronic device is provided, comprising an electronic device, comprising a first exciter, a second exciter, and a first panel and a second panel that are provided oppositely, wherein the first exciter is configured to control the first panel to vibrate, such that the first panel radiates a first sound wave, and the second exciter is configured to control the second panel to vibrate, such that the second panel radiates a second sound wave.

Optionally, the second exciter is configured to control the vibration of the second panel to offset with the vibration of the first panel at a first designated position.

Optionally, the first sound wave and the second sound wave offset each other to be weakened or superimpose each other to be enhanced at a second designated position.

Optionally, the electronic device further comprises a middle frame provided between the first panel and the second panel, wherein the first exciter is provided between the first panel and the middle frame, and the second exciter is provided between the second panel and the middle frame.

Optionally, both the first exciter and the second exciter are direct drive exciters, the first exciter is attached to the first panel and the middle frame, and the second exciter is attached to the second panel and the middle frame.

Optionally, both the first exciter and the second exciter are resonant exciters, the first exciter is attached to an inner side of the first panel, and the second exciter is attached to an inner side of the second panel.

Optionally, the resonant exciter comprises a resonator, a surface of the first exciter connected with the resonator is attached to the inner side of the first panel, and a surface of the second exciter connected with the resonator is attached to the inner side of the second panel.

Optionally, a position of the first exciter relative to the first panel is configured such that a vibration direction of the first exciter is perpendicular to the first panel, and a position of the second exciter relative to the second panel is configured such that a vibration direction of the second exciter is perpendicular to the second panel.

Optionally, the electronic device further comprises a signal source producing module, a first driving module and a second driving module, wherein the signal source producing module is configured to send out an audio driving signal, the first driving module is configured to process the audio driving signal to obtain a first driving signal, the first exciter is configured to control the first panel to vibrate according to the first driving signal, the second driving module is configured to process the audio driving signal to obtain a second driving signal, and the second exciter is configured to control the second panel to vibrate according to the second driving signal.

Optionally, the first driving module is configured to adjust the phase and/or amplitude of the audio driving signal to obtain the first driving signal, and the second driving module is configured to adjust the phase aid/or amplitude of the audio driving signal to obtain the second driving signal.

Optionally, the second exciter is further configured to control a vibration amplitude of the second panel to be equal to a vibration amplitude of the first panel.

As such, one beneficial effect of the present invention is that: two exciters are provided on the electronic device of the present invention to control the sound waves radiated by the vibration of the two panels, respectively, such that both the first panel and the second panel can be used as sound sources. The sound field of the first sound wave radiated by the first panel can be controlled by controlling the vibration mode of the second panel.

Other features and advantages of the invention will become clear from the following detailed description of exemplary embodiments of the invention with reference to the drawings.

BRIEF DESCRIPTION OF THE DRAWINGS

The drawings incorporated in the specification and constituting a part of the specification illustrate the embodiments of the present invention, and together with the description thereof, serve to explain the principle of the present invention.

DESCRIPTION OF REFERENCE SIGNS

Figure 1:
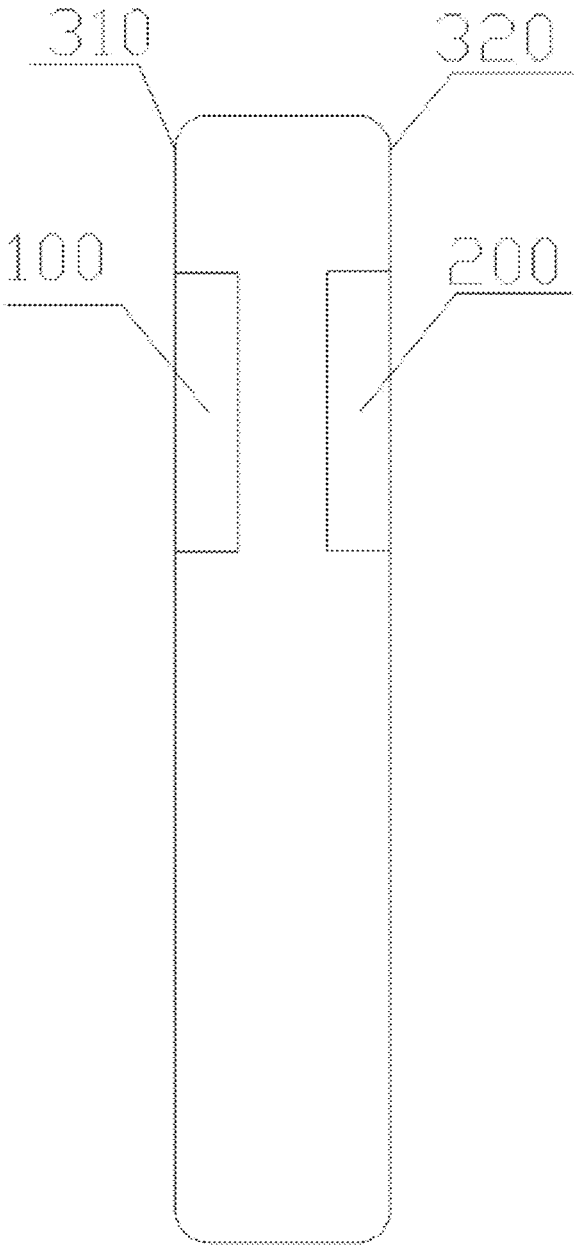
FIG. 1 is a schematic structural diagram of an embodiment of an electronic device according to the present invention.

100—first exciter; 200—second exciter;
310—first panel; 320—second panel;
400—signal producing module; 510—first driving module;
520—second driving module. 600—middle frame;
101, 102, 201, 202—electromagnetic assembly; 103, 203—resonator

DETAILED DESCRIPTION

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

The technologies, methods, and devices known to those of ordinary skill in the relevant fields may not be discussed in detail, but where appropriate, the technologies, methods, and devices should be regarded as part of the specification.

In all examples shown and discussed herein, any specific values should be interpreted as exemplary only and not as limitations. Therefore, other examples of the exemplary embodiment may have different values.

It should be noted that similar reference numerals and letters indicate similar items in the following drawings, so once an item is defined in one drawing, it does not need to be further discussed in the subsequent drawings.

In order to solve the problem that the electronic device in the prior art use a single panel to produce sound and make it impossible for the sound field of the sound wave radiated by the panel to be controlled, an electronic device is provided as shown in FIG. 1, the electronic device comprises: a first exciter 100, a second exciter 200, as well as a first panel 310 and a second panel 320 that are provided oppositely. The first panel 310 and the second panel 320 may be a display screen of an electronic device and a housing located on the back of the display screen, respectively. It is possible that the first panel 310 is a display screen and the second panel 320 is a housing, and it is also possible that the first panel 310 is a housing and the second panel 320 is a display screen. The first exciter 100 is configured to control the first panel 310 to vibrate, such that the first panel 310 radiates a first sound wave; and the second exciter 200 is configured to control the second panel 320 to vibrate, such that the second panel 320 radiates a second sound wave.

As such, two exciters that are provided on the electronic device of the present invention control the two panels to vibrate and radiate sound waves, respectively, such that both the first panel and the second panel can be used as sound sources. In this way, the electronic device can realize sound production via screen vibration, and the sound field of the first sound wave radiated by the first panel can be controlled by controlling the vibration mode of the second panel.

Further, the second exciter 200 is configured to control the vibration of the second panel 320 to offset with the vibration of the first panel 310 at a first designated position. Specifically, the second exciter 200 is configured to control the vibration of the second panel 320 to be in antiphase with the vibration of the first panel 310, so that the vibration of the first panel 310 and that of the second panel 320 can offset each other at the first designated position. As such, vibration at the first designated position is weakened, thereby reducing the user's feeling of hand vibrating at the first designated position and improving the user experience.

Further, the second exciter 200 is configured to control the vibration phase of the second panel 320 to be in antiphase with the vibration phase of the first panel 310 at the first designated position, thereby achieving the purpose that the vibrations at the first designated position offset each other.

It should be noted that the first designated position is preset according to actual needs, and may be the frame of the electronic device or a middle frame thereof, which is not limited in the present invention.

Further, the first sound wave and the second sound wave offset each other to be weakened or superimpose each other to be enhanced at a second designated position. Specifically, the second exciter 200 is configured to control the vibration of the second panel 320 to be in antiphase with the vibration of the first panel 310. If the first sound wave and the second sound wave are superimposed to be enhanced at the second designated position, vibration and sound production of the electronic device would be enhanced. Otherwise, if the first sound wave and the second sound wave offset each other to be weakened at the second designated position; sound leakage at the second designated position can be reduced. As such, user experience can be improved.

It should be noted that the second designated position is preset according to actual needs and not limited in the present invention.

Further, since the second exciter 200 is configured to control the vibration of the second panel 320 to be in antiphase with the vibration of the first panel 310, the first sound wave radiated by the first panel and the second sound wave radiated by the second panel propagate in opposite directions at a certain position, thereby reducing the risk of acoustic short circuit at such position.

Furthermore, in the prior art, only the first exciter 100 is provided on the first panel 310, and when the first exciter 100 controls the first panel 310 to vibrate, the first panel 310 will radiate a sound wave. Due to the air pressure inside an enclosed cavity formed between the first panel 310 and the second panel 320, the second panel 320 will vibrate in the same direction with the first panel 310, and will also radiate a sound wave. Since sound waves produced when the panel moves forward are in antiphase with that produced when the panel moves backward, the sound waves radiated by the first panel 310 and the sound waves radiated by the second panel 320 may offset each other, resulting in a phenomenon of the acoustic short circuit.

In the present invention, the first exciter 100 is provided on the first panel 310 and a second exciter 200 is provided on the second panel 320; the first exciter 100 controls the first panel 310 to vibrate, such that the first panel 310 can radiate the first sound wave, and the second exciter 200 controls the second panel 320 to vibrate, such that the second panel 320 can radiate the second sound wave. Since the vibration of the first panel 310 and that of the second panel arc in antiphase at the same moment, the first sound wave and the second sound wave propagate in opposite directions. In this way, it is possible to reduce the risk of the acoustic short circuit.

Furthermore, the electronic device of the present invention may further comprise a middle frame 600 provided between the first panel 310 and the second panel 320. The middle frame 600 plays a role of reinforcing, and can be used to fix the circuit boards, the batteries, or the like, of the electronic device. Under normal circumstances, the first exciter 100 may be provided between the first panel 310 and the middle frame 600, and the second exciter 200 may be provided between the second panel 320 and the middle frame 600.

Specifically, the first panel 310, the middle frame 600, and the second panel 320 are connected by other sealing components, and the middle frame 600 is hollowed out, such that a closed cavity is formed between the first panel 310 and the second panel 320. If only the first panel 310 is provided with an exciter, when the first panel 310 vibrates, the second panel 320 will vibrate in the same direction with the first panel 310 due to the air pressure inside the cavity. Moreover, such vibration in the same direction will superimpose, and enhance the vibration feeling caused by the middle frame 600.

In the electronic device of the present invention, the first exciter 100 is provided on the first panel 310, and the second exciter 200 is provided on the second panel 320. By controlling the vibrations of the first exciter 100 and the second exciter 200, the vibrations of the first panel and the second panel are made to be in antiphase. That is, the vibrations of the first panel 310 and the second panel 320 can offset each other at the middle frame, such that the vibration of the middle frame 600 can be weakened. In this way, the user's feeling of hand-vibrating can be reduced, thereby improving the user experience.

In order to facilitate the first exciter 100 to control the vibration of the first panel 310, the first exciter 100 may be attached to the first panel 310. In order to facilitate the second exciter 200 to control the vibration of the second panel 320, the second exciter 200 may be attached to the second panel 320.

In an example, a position of the first exciter 100 relative to the first panel 310 may be configured such that a vibration direction of the first exciter 100 is perpendicular to the first panel 310, and a position of the second exciter 200 relative to the second panel 320 is configured such that a vibration direction of the second exciter 200 is perpendicular to the second panel 320. As such, the vibration intensity of the first panel 310 and the second panel can be enhanced, thereby improving the efficiency of radiating sound waves.

Figure 2:
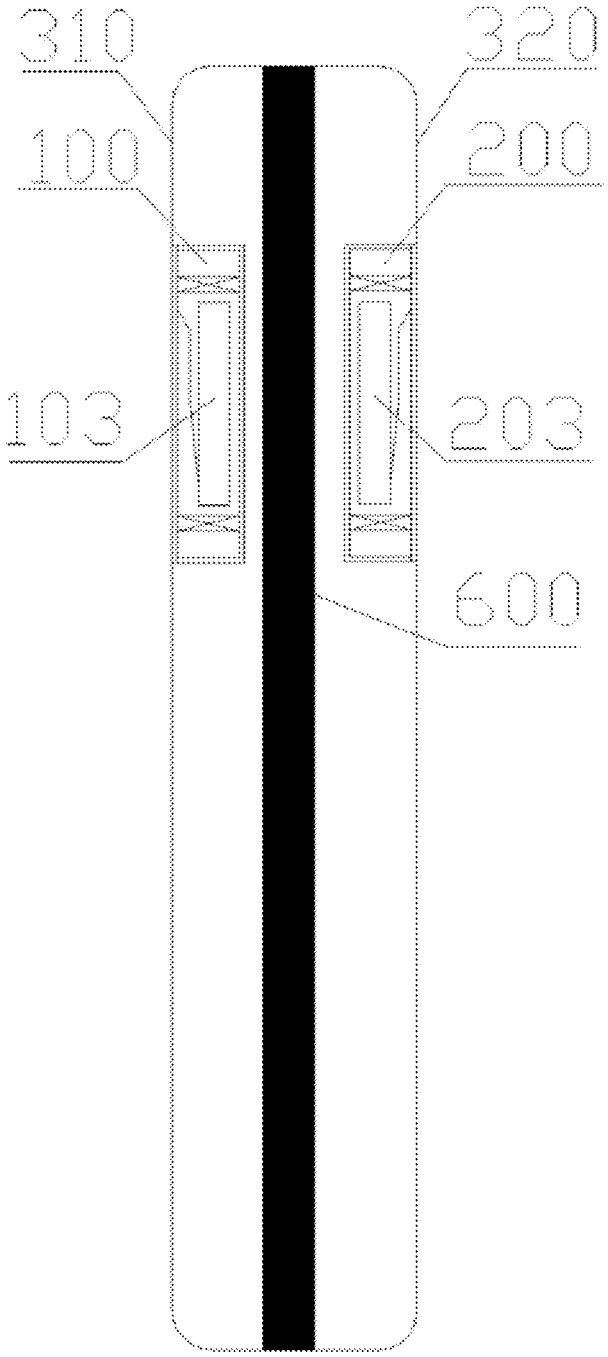
FIG. 2 is a schematic structural diagram of an embodiment of an electronic device according to the present invention.
Figure 3:
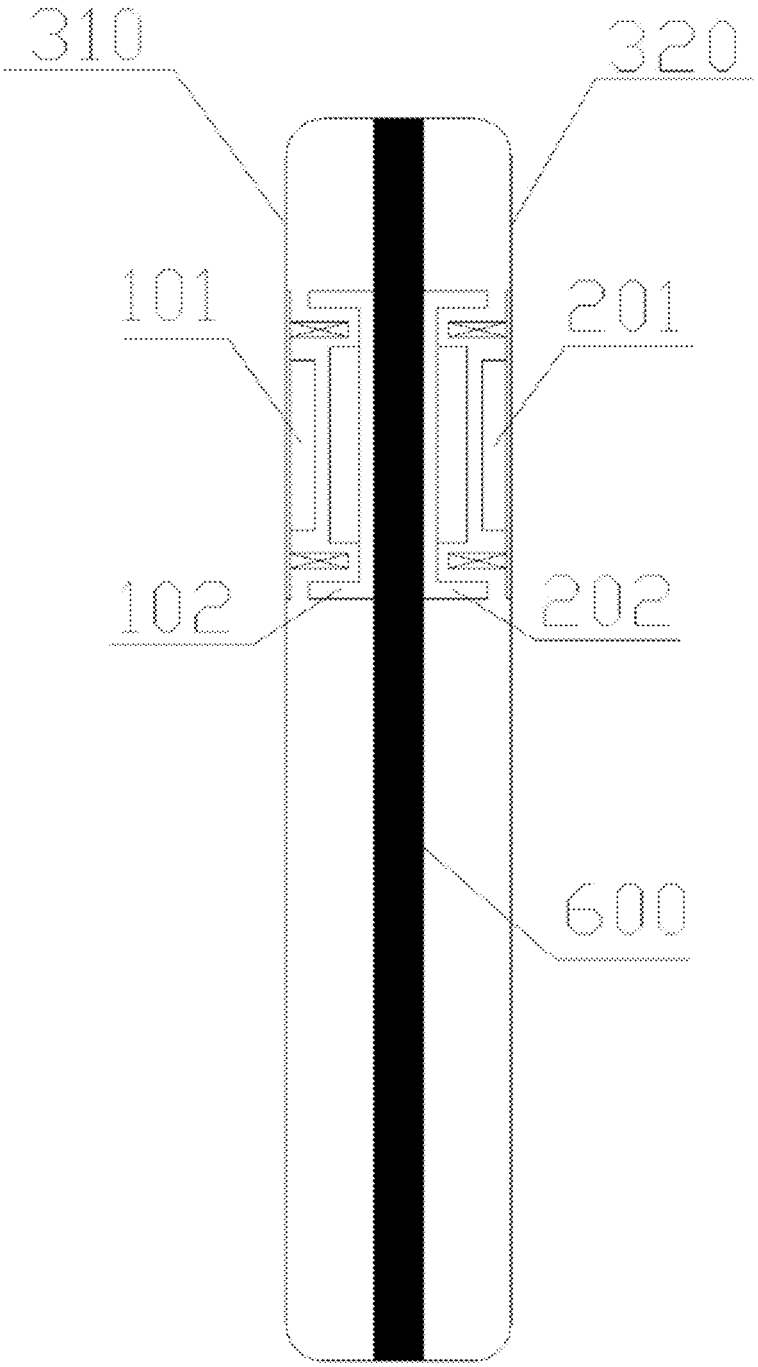
FIG. 3 is a schematic structural diagram of an embodiment of an electronic device according to the present invention.

In an example, as shown in FIGS. 2 and 3, the position of the first exciter 100 relative to the second exciter 200 may be configured such that the internal structures of the first exciter 100 and the second exciter 200 are symmetrical. As such, the first exciter 100 and the second exciter 200 can be driven simultaneously by one driving signal, such that the vibration directions of the first panel 310 and the second panel 320 are opposite.

Further, the position of the first exciter 100 relative to the second exciter 200 may be configured such that the first exciter 100 and the second exciter 200 avoid each other relative to the middle plane, or the first exciter 100 and the second exciter 200 are symmetrical with respect to the middle plane. The middle plane is a plane located between the first panel 310 and the second panel 320, where a distance between the middle plane and the first panel 310 is equal to a distance between the middle plane and the second panel 320.

As shown in FIG. 2, both the first exciter 100 and the second exciter 200 are direct drive exciters. A direct drive exciter generally comprises two electromagnetic assemblies, where one of which is provided with a coil. When the coil is energized, an interaction force is produced between the two electromagnetic assemblies due to electromagnetic force. The first exciter 100 comprises electromagnetic assemblies 101 and 102, and an interaction force is produced between the electromagnetic assemblies 101 and 102. The second exciter 200 comprises electromagnetic assemblies 201 and 202, and an interaction force is produced between the electromagnetic assemblies 201 and 202.

In order to enable the first exciter 100 to control the vibration of the first panel 310 and the second exciter 200 to control the vibration of the second panel 320, it is possible that the electromagnetic assembly 101 provided with the coil, of the first exciter 100 may be attached to the inner side of the first panel 310, and another electromagnetic assembly 102 is attached to a surface of the middle frame 600 opposite to the inner side of the first panel 310; the electromagnetic assembly 201 provided with the coil, of the second exciter 200 is attached to the inner side of the second panel 320, and the other electromagnetic assembly 202 is attached to a surface of the middle frame 600 opposite to the inner side of the second panel 320. It is also possible that, the electromagnetic assembly 101 provided with the coil, of the first exciter 100 is attached to the surface of the middle frame 600 opposite to the inner side of the first panel 310, and the other electromagnetic assembly 102 is attached to the inner side of the first panel 310; the electromagnetic assembly 201 provided with the coil, of the second exciter 200 is attached to the surface of the middle frame 600 opposite to the inner side of the second panel 320, and the other electromagnetic assembly 202 is attached to the inner side of the second panel 320.

As such, due to the interaction force produced between the two electromagnetic assemblies 101 and 102 of the first exciter 100, the first panel 310 may be driven to undergo bending vibration and radiate sound waves. Due to the interaction force produced between the two electromagnetic assemblies 201 and 202 of the second exciter 200, the second panel 320 may be driven to undergo bending vibration and radiate sound waves.

It should be noted that the inner side of the first panel is a side of the first panel opposite to the second panel, that is, a side close to the second panel. Similarly, the inner side of the second panel is a side of the second panel opposite to the first panel, that is, a side close to the first panel.

As shown in FIG. 3, both the first exciter 100 and the second exciter 200 are resonant exciters. The resonant exciter is a complete assembly, where a resonator is provided in the complete assembly, The resonator is combined with the complete assembly via an elastic component. The complete assembly further comprises a coil. When the coil is energized, the resonator will vibrate.

In order to enable the first exciter 100 to control the vibration of the first panel 310 and the second exciter 200 to control the vibration of the second panel 320, the surface of the first exciter 100 connected with the resonator 103 may be rigidly connected to the inner side of the first panel 310, and the surface of the second exciter 200 connected with the resonator 203 may be rigidly connected to the inner side of the second panel 120.

As such, during the vibration of the resonator of the first exciter 100, due to the inertial effect, the first panel 310 will be driven to undergo bending vibration, thereby radiating the sound waves. During the vibration of the resonator of the second exciter 200, due to the inertial effect, the second panel 320 will be driven to undergo bending vibration, thereby radiating the sound waves.

Further, since the position of the first exciter 100 relative to the second exciter 200 is configured such that the internal structures of the first exciter 100 and the second exciter 200 are symmetrical, under the ideal circumstances that the mechanical properties and materials of the first panel 310 and the second panel 320 are exactly the same, and the electronic device is symmetrical with respect to the plane between the first panel 310 and the second panel 320, the first exciter 100 and the second exciter 200 can be driven by the same driving signal such that the first panel 310 and the second panel 320 vibrate in the same vibration amplitude and in anti-phase.

In actual practices, the mechanical properties and materials of the first panel 310 and the second panel 320 may be different, and the internal structure of the electronic device may also be asymmetrical. If the first exciter 100 and the second exciter 200 are driven by the same driving signal, the vibration directions of the first panel 310 and the second panel 320 are opposite, but the vibration amplitudes may be different.

In an example, the second exciter 200 may also be configured to control the vibration amplitude of the second panel 320 to be equal to the vibration amplitude of the first panel 310. As such, when the first panel 310 and the second panel 320 vibrate in antiphase and have the same vibration amplitude, the vibration intensity of the middle frame 600 can be further reduced, the user's feeling of hand-vibrating can be alleviated, and the user experience can be further improved.

Figure 4:
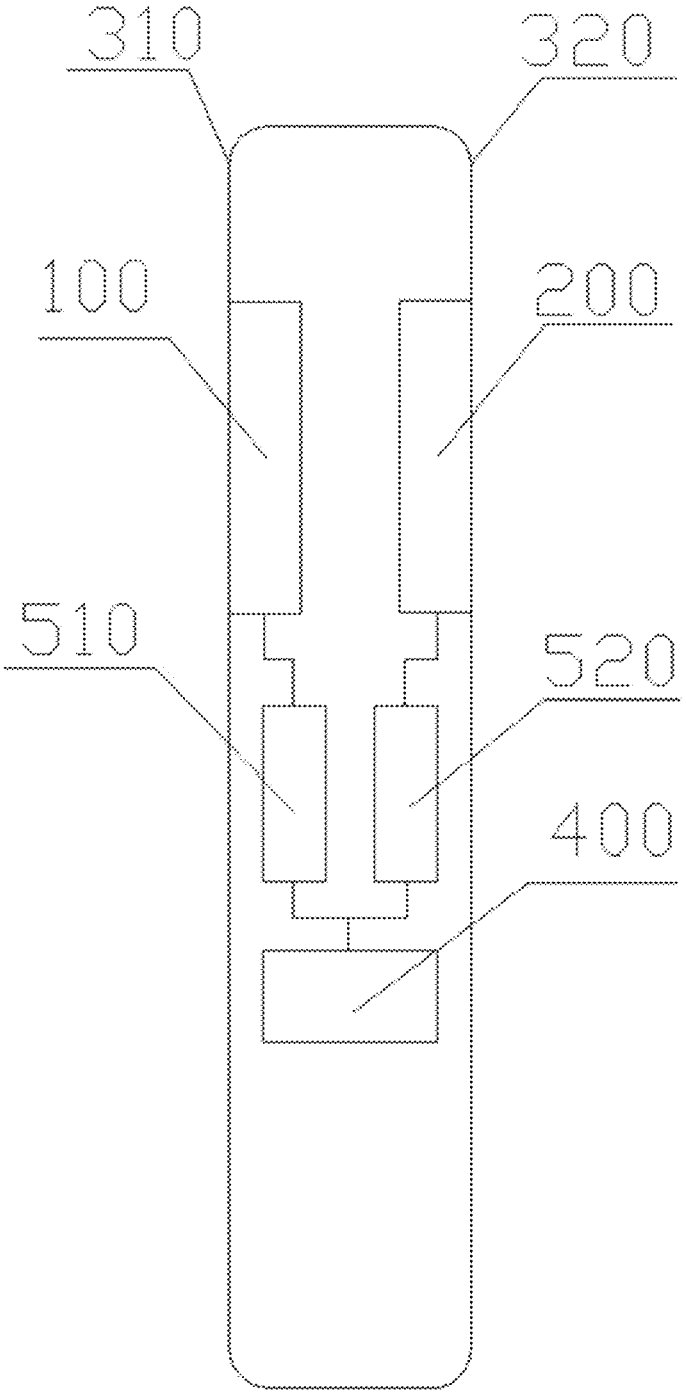
FIG. 4 is a schematic structural diagram of an embodiment of an electronic device according to the present invention.

In order to obtain the effect that the first panel 310 and the second panel 320 vibrate in antiphase with approximately the same vibration amplitude, the first exciter 100 and the second exciter 200 may be driven by different driving signals. However, in order to ensure that the user can hear a clear and normal sound when the first sound wave radiated by the first panel 310 and the second sound wave radiated by the second panel 320 reach the user's ears, as shown in FIG. 4, the electronic device may further comprise a signal source producing module 400, a first driving module 510, and a second driving module 520. The signal source producing module 400 is configured to send out an audio driving signal. The first driving module 510 is configured to process the audio driving signal to obtain a first driving signal. The first exciter 100 is configured to control the first panel 310 to vibrate according to the first driving signal. The second driving module 520 is configured to process the audio driving signal to obtain a second driving signal. The second exciter 200 is configured to control the second panel 320 to vibrate according to the second driving signal.

Specifically, the audio driving signal may be audio data pre-stored in the electronic device, or may be audio data obtained from a network. The first driving module 510 may amplify the audio driving signal, so that the obtained first driving signal can drive the first exciter 100 to vibrate, which in turn drives the first panel 310 to vibrate and radiate a first sound wave matching the audio driving signal. The second driving module 520 may adjust the audio driving signal and then amplify it, so that the obtained second driving signal can drive the second exciter 200 to vibrate, thereby driving the second panel 320 to vibrate and causing the vibration intensity of the second panel 320 to satisfy the expectation. The second panel 320 can radiate the second sound wave matching the audio driving signal. As such, the first sound wave and the second sound wave can be automatically integrated in the propagation process before reaching the user's ears, so that the user can hear a sound consistent with the audio driving signal.

Further, the first driving module 510 and the second driving module 520 may process the audio driving signal by adjusting the amplitude and/or phase of each signal point of the audio driving signal, such that the first panel 310 and the second panel 320 vibrate in antiphase with approximately the same vibration amplitude. The vibration amplitudes of the first panel 310 and the second panel 320 are approximately equal; in particular, it may be that the difference between the vibration amplitude of the first panel 310 and that of the second panel 320 is smaller than a preset threshold.

In this way, the first drive module 510 and the second drive module 520 can control the vibration of the last exciter 100 to drive the first panel 310 to be in antiphase with the vibration of the second exciter 200 to drive the second panel 320, vibration of the electronic device at the first designated position can be offset, and the vibration feeling at the first designated position can be alleviated. In addition, it can make the first sound wave emitted by the vibration of the first panel 310 and the second sound wave emitted by the vibration of the second panel 320 propagate in opposite directions at a specified position, thereby reducing the risk of acoustic short circuit at such position.

The foregoing embodiments mainly focus on the differences from other embodiments, but it should be dear to those skilled in the art that the foregoing embodiments can be used individually or in combination with each other as required.

Although some specific embodiments of the present invention have been described in detail through examples, those skilled in the art should understand that the above examples are only for illustration and not for limiting the scope of the present invention. It should be understood by a person skilled in the art that the above embodiments can be modified without departing from the scope and spirit of the present invention. The scope of the present invention is defined by the attached claims.

The invention claimed is:

1. An electronic device, comprising a first exciter, a second exciter, a first panel, a second panel that are provided oppositely, wherein the first exciter is configured to control the first panel to vibrate, such that the first panel radiates a first sound wave, and the second exciter is configured to control the second panel to vibrate, such that the second panel radiates a second sound wave, a signal source producing module, a first driving module, and a second driving module, wherein the signal source producing module is configured to send out an audio driving signal, wherein the first driving module is configured to process the audio driving signal to obtain a first driving signal, wherein the first exciter is configured to control the first panel to vibrate according to the first driving signal, wherein the second driving module is configured to process the audio driving signal to obtain a second driving signal, and the second exciter is configured to control the second panel to vibrate according to the second driving signal whereby the first driving signal and the second driving signal provide for opposite vibration directions of the first panel and the second panel, and wherein the first panel and the second panel vibrate in antiphase with the same vibration amplitude.

2. The electronic device according to claim 1, wherein the second exciter is configured to control the vibration of the second panel to offset with the vibration of the first panel at a first position.

3. The electronic device according to claim 1, wherein the first exciter and the second exciter are configured such that the first sound wave and the second sound wave either offset each other to be weakened or superimpose each other to be enhanced at a second position.

4. The electronic device according to claim 1, further comprising a middle frame provided between the first panel and the second panel, wherein the first exciter is provided between the first panel and the middle frame, and the second exciter is provided between the second panel and the middle frame.

5. The electronic device according to claim 4, wherein both the first exciter and the second exciter are direct drive exciters, the first exciter is attached to the first panel and the middle frame, and the second exciter is attached to the second panel and the middle frame.

6. The electronic device according claim 4, wherein both the first exciter and the second exciter are resonant exciters, the first exciter is attached to an inner side of the first panel, and the second exciter s attached to an inner side of the second panel.

7. The electronic device according to claim 6, wherein the resonant exciter comprises a resonator, a surface of the first exciter connected with the resonator is attached to the inner side of the first panel, and a surface of the second exciter connected with the resonator is attached to the inner side of the second panel.

8. The electronic device according to claim 1, wherein a position of the first exciter relative to the first panel is configured such that a. vibration direction of the first exciter is perpendicular to the first panel, and a position of the second exciter relative to the second. panel is configured such that a vibration direction of the second. exciter is perpendicular to the second. panel.

9. The electronic device according to claim 2, wherein the second exciter is further configured to control a vibration amplitude of the second panel to be equal to a vibration amplitude of the first panel.

* * * * *